US008923742B2

(12) United States Patent
Ueno et al.

(10) Patent No.: US 8,923,742 B2
(45) Date of Patent: Dec. 30, 2014

(54) FIXING DEVICE AND IMAGE FORMING APPARATUS

(75) Inventors: Osamu Ueno, Kanagawa (JP); Tomoaki Kojima, Kanagawa (JP); Hideo Nakayama, Kanagawa (JP); Masateru Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 292 days.

(21) Appl. No.: 13/399,104

(22) Filed: Feb. 17, 2012

(65) Prior Publication Data

US 2013/0071161 A1 Mar. 21, 2013

(30) Foreign Application Priority Data

Sep. 21, 2011 (JP) ..... 2011-206247

(51) Int. Cl.
*G03G 15/20* (2006.01)

(52) U.S. Cl.
CPC ..... *G03G 15/2007* (2013.01)
USPC ..... 399/336; 399/122

(58) Field of Classification Search
CPC ..... G03G 15/2021; G03G 15/2007; G03G 15/201; G03G 15/2003
USPC ..... 399/122, 335–337
See application file for complete search history.

(56) References Cited

U.S. PATENT DOCUMENTS

| | | | | |
|---|---|---|---|---|
| 2006/0050133 | A1* | 3/2006 | Kokubo | 347/129 |
| 2008/0069588 | A1 | 3/2008 | Inaba et al. | |
| 2010/0038671 | A1* | 2/2010 | Kondoh | 257/99 |

FOREIGN PATENT DOCUMENTS

| | | | |
|---|---|---|---|
| JP | 07-191560 | A | 7/1995 |
| JP | 2008-096964 | A | 4/2008 |
| JP | 2009-083208 | A | 4/2009 |
| JP | 2010-217235 | A | 9/2010 |

* cited by examiner

*Primary Examiner* — Walter L Lindsay, Jr.
*Assistant Examiner* — Jessica L Eley
(74) *Attorney, Agent, or Firm* — Sughrue Mion, PLLC

(57) ABSTRACT

A fixing device includes a transport member that transports a recording medium in a first direction, the recording medium having on one side thereof an image formed of an image forming material that is to be fixed by absorbing light; a first chip that has a first light-emitting area in which a plurality of light-emitting elements that emit light toward the one side of the recording medium are arranged two-dimensionally; and a second chip that has a second light-emitting area in which a plurality of light-emitting elements that emit light toward the one side of the recording medium are arranged two-dimensionally. A gap between the first light-emitting area and the second light-emitting area extends at an angle with respect to the first direction, and a portion of the first light-emitting area and a portion of the second light-emitting area overlap each other in the first direction.

8 Claims, 17 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2011-206247 filed Sep. 21, 2011.

BACKGROUND (i) Technical Field

The present invention relates to a fixing device and an image forming apparatus.

(ii) Related Art

Exemplary techniques of fixing toner transferred onto paper in image forming apparatuses include a technique in which light, such as a laser beam, is applied to the toner on the paper.

SUMMARY

According to an aspect of the invention, there is provided a fixing device including a transport member that transports a recording medium in a first direction, the recording medium having on one side thereof an image formed of an image forming material that is to be fixed by absorbing light; a first chip that has a first light-emitting area in which a plurality of light-emitting elements that emit light toward the one side of the recording medium are arranged two-dimensionally; and a second chip that has a second light-emitting area in which a plurality of light-emitting elements that emit light toward the one side of the recording medium are arranged two-dimensionally. A gap between the first light-emitting area and the second light-emitting area extends at an angle with respect to the first direction, and a portion of the first light-emitting area and a portion of the second light-emitting area overlap each other in the first direction.

BRIEF DESCRIPTION OF THE DRAWINGS

Exemplary embodiments of the present invention will be described in detail based on the following figures, wherein.

DETAILED DESCRIPTION

Figure 1:
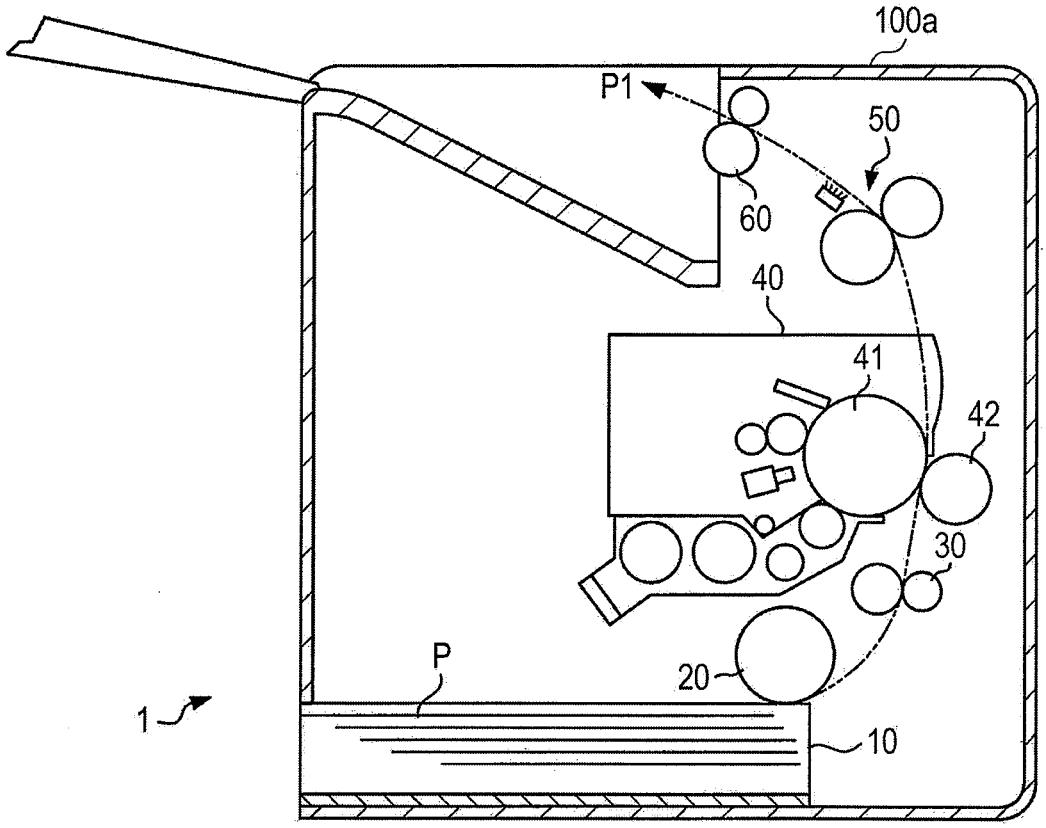
FIG. 1 schematically illustrates the inside of an image forming apparatus according to an exemplary embodiment of the invention.

FIG. 1 schematically illustrates the inside of an image forming apparatus 1 according to an exemplary embodiment of the present invention. The image forming apparatus 1 functions as a copier, a printer, a scanner, a facsimile, or the like. The image forming apparatus 1 includes a housing 100*a*, in which a container 10, a feed roller 20, transport rollers 30, a transfer unit 40, a fixing unit 50, and output rollers 60 are provided. The container 10 contains paper P (an exemplary recording medium). The feed roller 20 comes into contact with the top one of pieces of paper P contained in the container 10 and feeds the piece of paper P along a transport path (represented by chain line P1). The transport rollers 30 transports the piece of paper P that is fed by the feed roller 20. The transport rollers 30 transports the piece of paper P in accordance with the timing at which the transfer unit 40 forms a toner image. The transfer unit 40 transfers the toner image onto the piece of paper P that is transported by the transport rollers 30. The transfer unit 40 includes a photoconductor 41 and a transfer roller 42. The transfer unit 40 also includes elements that are responsible for charging, exposure, and development performed so as to form the toner image on the photoconductor 41. The transfer roller 42 transfers the toner image formed on the photoconductor 41 onto the piece of paper P. The side of a piece of paper P onto which a toner image is to be transferred (the side that is to come into contact with the photoconductor 41) is hereinafter referred to as the front side (exemplary one side) of the piece of paper P. The fixing unit 50 (an exemplary fixing device) fixes the toner image that is transferred to the piece of paper P by the transfer unit 40 on the piece of paper P. The output rollers 60 output the piece of paper P having the fixed toner image from the image forming apparatus 1.

The image forming apparatus 1 also includes a controller, a communication unit, a storage unit, and a power supply unit (all not illustrated). The controller controls operations performed by the above-described elements included in the image forming apparatus 1. The controller includes a central processing unit (CPU), a read-only memory (ROM), and a random-access memory (RAM). The communication unit connects to an external apparatus such as a personal computer or a facsimile and is responsible for transmission/reception of image data. The storage unit includes a device, such as a hard disk drive (HDD), that stores data and programs used by the controller. The power supply unit supplies power that is necessary for activating the elements of the image forming apparatus 1. The image forming apparatus 1 configured as described above performs the formation and fixing of a toner image on the front side of the paper P while the paper P is transported along the transport path. Hereinafter, the direction in which the paper P is transported is referred to as "transport direction" (an exemplary first direction), a direction orthogonal to the transport direction is referred to as "width direction" (an exemplary second direction), and a dimension of the paper P in the width direction is referred to as "paper width".

Figure 2:
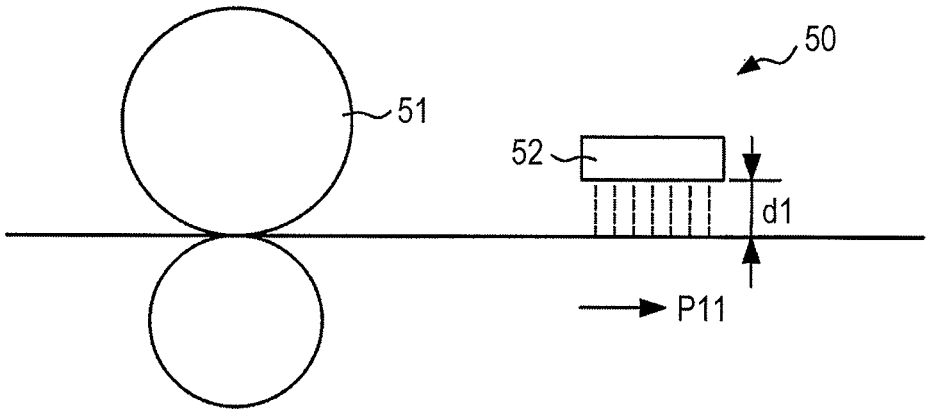
FIG. 2 schematically illustrates a fixing unit according to the exemplary embodiment.

FIG. 2 schematically illustrates the fixing unit 50 according to the exemplary embodiment of the invention. The fixing unit 50 includes a transport member 51 and a light emitter 52. The transport member 51 transports the paper P having the toner image transferred thereonto by the transfer unit 40 toward the light emitter 52 (in a direction indicated by arrow P11). The front side of the paper P faces the light emitter 52. The light emitter 52 is a light source that supplies energy for fixing toner particles on the paper P. When light is applied to the toner particles transferred onto the paper P, the toner particles melt and are fixed on the paper P. The light emitter 52 is provided at a distance d1 from the transport path.

Figure 3:
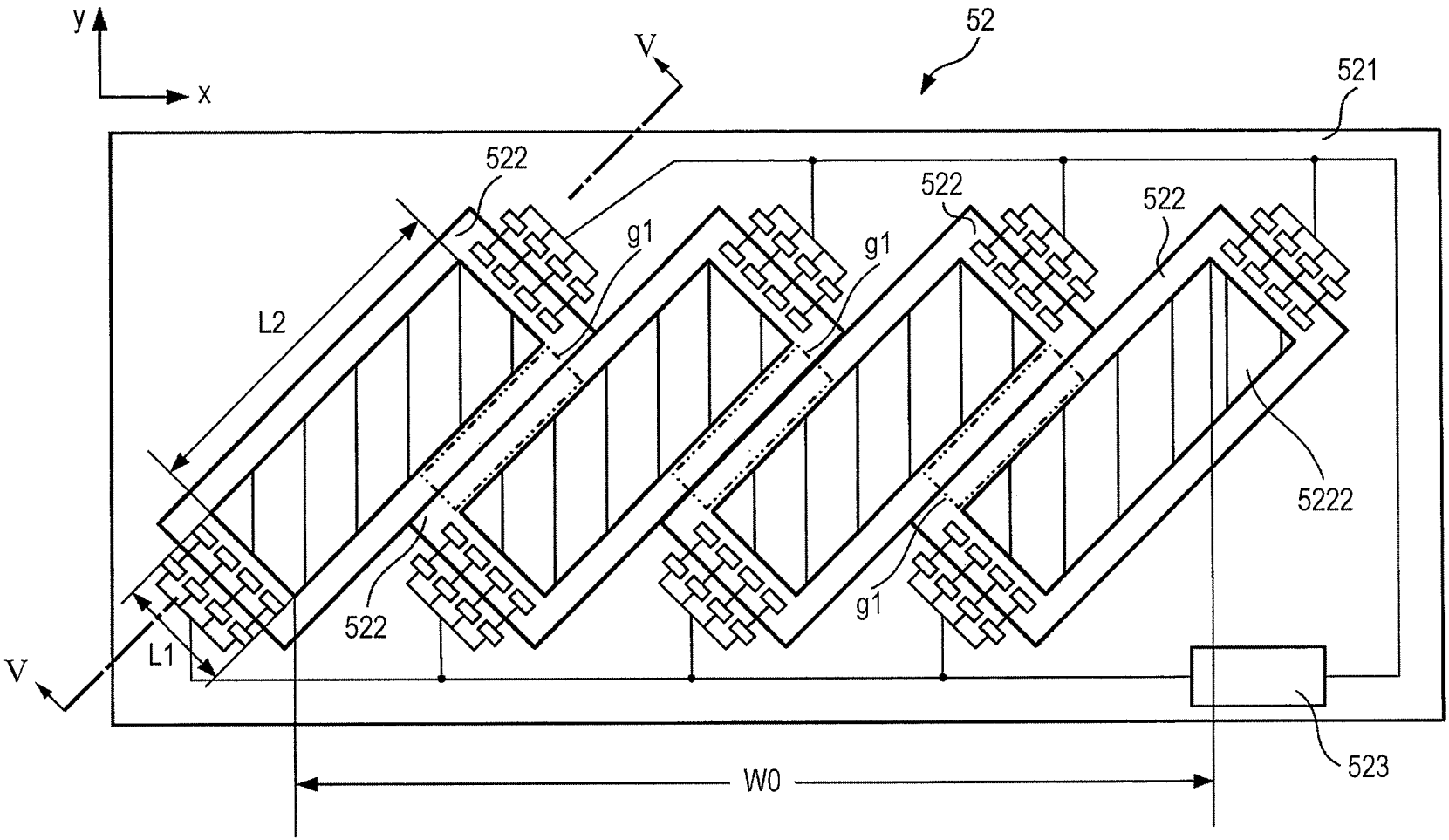
FIG. 3 illustrates an exemplary configuration of a light emitter according to the exemplary embodiment.

FIG. 3 illustrates an exemplary configuration of the light emitter 52. The x axis corresponds to the width direction, and the y axis corresponds to the transport direction. The light emitter 52 includes a substrate 521, plural chips 522, and a driving circuit 523. The chips 522 are arranged in the width direction and are die-attached to the substrate 521. In FIG. 3, the chips 522 are closely arranged without gaps therebetween. In this exemplary configuration, the chips 522 are laser array chips and each include plural light-emitting elements. The driving circuit 523 outputs driving signals for driving laser arrays.

Figure 4:
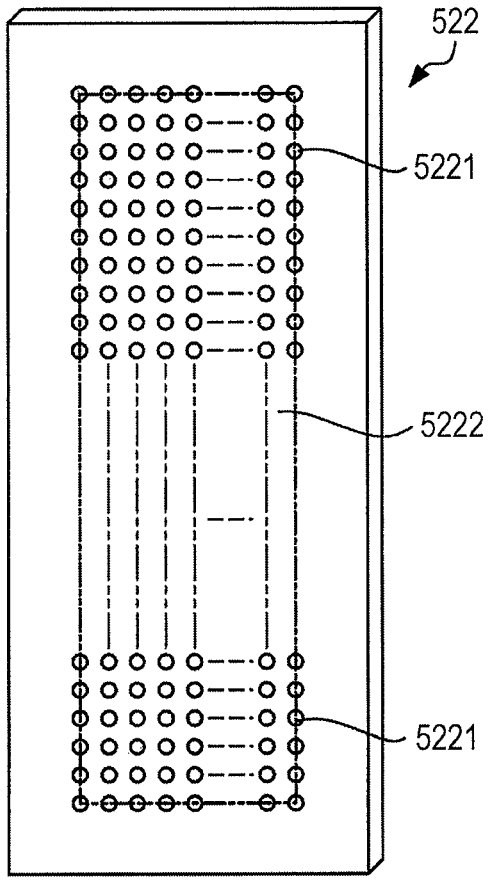
FIG. 4 illustrates an exemplary configuration of a chip according to the exemplary embodiment.

FIG. 4 illustrates an exemplary configuration of the chip 522. The chip 522 includes plural light-emitting elements 5221. In this exemplary configuration, the light-emitting elements 5221 are semiconductor lasers, more specifically, vertical-cavity surface-emitting lasers (VCSELs). VCSELs emit light vertically from the surface of a substrate. The light-emitting elements 5221 are arranged in a matrix (a two-dimensional pattern) and thus form a light-emitting area 5222. A light-emitting area is defined by a quadrilateral that circumscribes the plural light-emitting elements. In FIG. 4, the four sides of the quadrilateral circumscribing the light-emitting elements 5221 are parallel to the four respective sides of the chip 522. In the exemplary configuration illustrated in FIGS. 3 and 4, the light-emitting area 5222 has a rectangular or substantially rectangular shape.

Figure 5:
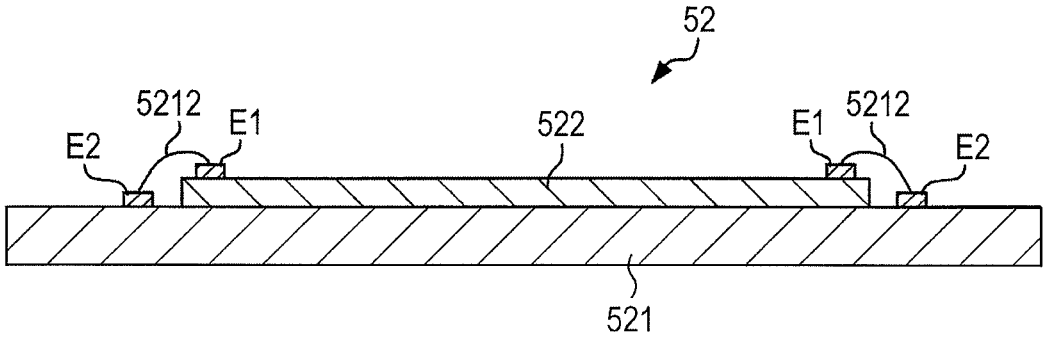
FIG. 5 is a sectional view of the light emitter taken along line V-V illustrated in FIG. 3.

FIG. 5 is a sectional view of the light emitter 52 taken along line V-V illustrated in FIG. 3. The chip 522 has electrodes E1 provided on the surface thereof. The substrate 521 has electrodes E2. The electrodes E1 and the electrodes E2 are connected to each other with bonding wires 5212. The bonding wires 5212 are made of an electric conductor such as Al, Cu, or Au. The electrodes E2 are connected to the driving circuit 523 through wires (not illustrated) provided on the substrate 521. The driving signals that are output from the driving circuit 523 are supplied to the light-emitting elements 5221 through the wires, the electrodes E2, and the electrodes E1.

Figure 6:
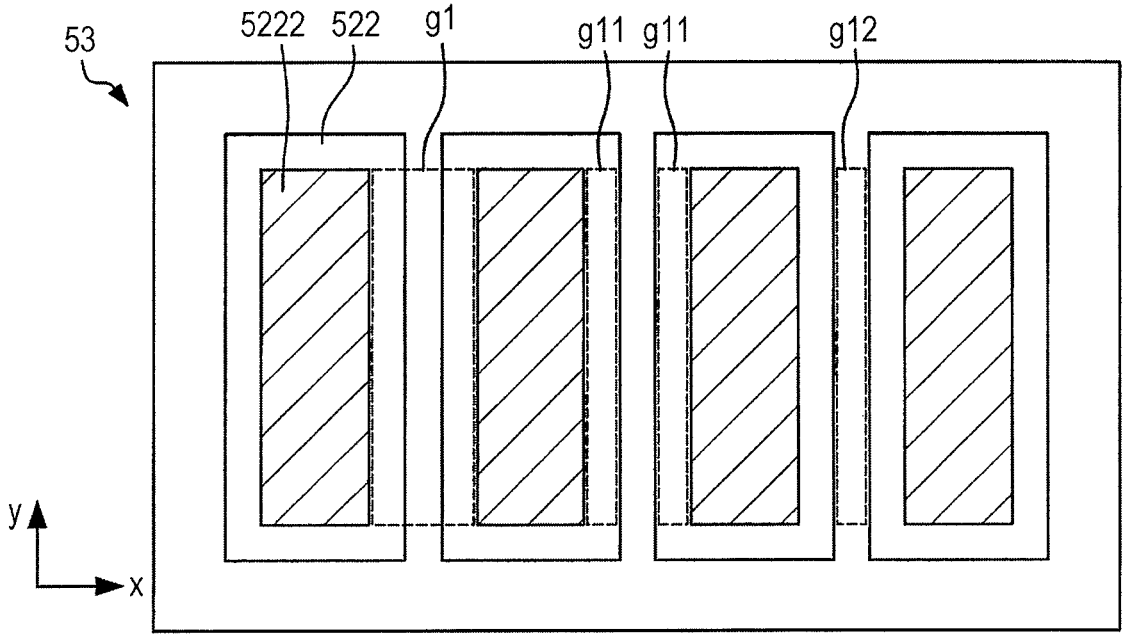
FIG. 6 illustrates a light emitter according to a comparative example.

FIG. 6 illustrates a light emitter 53 according to a comparative example. In the comparative example, chips 522 are arranged such that a gap g1 between each adjacent two of plural light-emitting areas 5222 extend parallel to the transport direction. The term "gap" herein refers to an area extending between two adjacent light-emitting areas. The gap includes areas each defined between an end of one light-emitting area and a corresponding one of the ends of the chip having that light-emitting area, and an area sandwiched between the two adjacent chips. In FIG. 6, the gaps g1 each include areas g11 each defined between an end of one light-emitting area 5222 and a corresponding one of the ends of the chip 522 having that light-emitting area 5222, and an area g12 sandwiched between two adjacent ones of the chips 522.

Figure 7A:
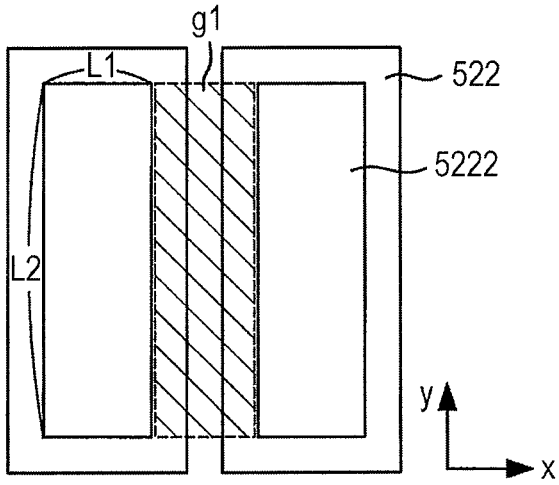
FIGS. 7A and 7B each illustrate a gap between light-emitting areas.
Figure 7B:
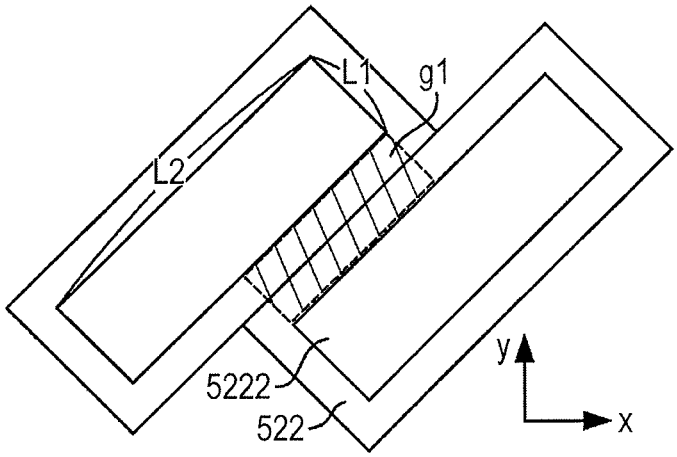

FIGS. 7A and 7B each illustrate the gap g1 between two light-emitting areas 5222. FIG. 7A illustrates an exemplary arrangement in which the two chips 522 are provided side by side such that each short side of one of the chips 522 and a corresponding one of the short sides of the other chip 522 are in one straight line. FIG. 7B illustrates another exemplary arrangement in which the two chips 522 are provided with the short sides of the respective chips 522 staggered from each other. Each light-emitting area 5222 has the short sides L1 (exemplary first-length sides) and long sides L2 (exemplary second-length sides). The term "gap" refers to an area enclosed by the extensions of the short sides of two adjacent light-emitting areas, a long side of one of the two adjacent light-emitting areas, and a long side of the other light-emitting area that faces the former long side. In the cases illustrated in FIGS. 7A and 7B, the gap g1 is an area (the hatched area) enclosed by the extensions of the short sides L1 of the two adjacent light-emitting areas 5222, a long side L2 of one of the two adjacent light-emitting areas 5222, and a long side L2 of the other light-emitting area 5222 that faces the former long side L2.

Figure 8:
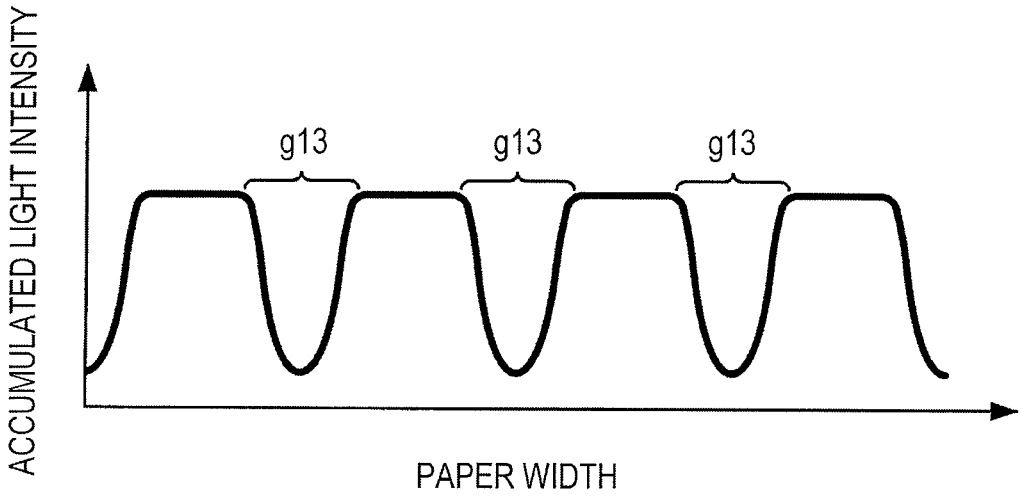
FIG. 8 is a graph illustrating the accumulated intensity of light applied to paper in the comparative example.

FIG. 8 is a graph illustrating the accumulated intensity of light applied to the paper P (hereinafter also referred to as "accumulated light intensity") in the comparative example. The horizontal axis of the graph represents the position on the paper P in the width direction. The vertical axis of the graph represents the intensity of light applied to the paper P that accumulates in the transport direction. The intensity of light applied to a point on the paper P that accumulates during a period of time (an exemplary predetermined period of time) in which that point on the paper P passes through an area of the transport path that faces the light-emitting area 5222 (hereinafter referred to as "light application area") varies with position on the paper P in the width direction. For example, in portions g13 of the paper P that face the gaps g1 of the light emitter 53, the accumulated light intensity is lower than in the other portions. If the variation in the accumulated light intensity (the difference between the highest value and the lowest value) is large, the degree of melting of toner particles changes correspondingly. Consequently, the light emitter 53 according to the comparative example illustrated in FIG. 6 may cause nonuniformity in the fixing state of toner particles on the paper P.

Referring to FIG. 3 again, in the light emitter 52 according to the exemplary embodiment, the light-emitting areas 5222 each has a rectangular or substantially rectangular shape having short sides L1 and long sides L2. Each chip 522 is oriented such that the long sides L2 of the light-emitting area 5222 are angled by 45 degrees with respect to the transport direction. The angle formed between a virtual line extending in the transport direction and each long side L2 is not necessarily be exactly 45 degrees and may include a certain margin of error with respect to 45 degrees. The margin of error only needs to fall within a range in which the user cannot recognize probable nonuniformity in the fixing state of toner particles on the paper P. Since the long sides L2 are angled by 45 degrees with respect to the transport direction, the gaps g1 extend at an angle with respect to the transport direction.

Figure 9:
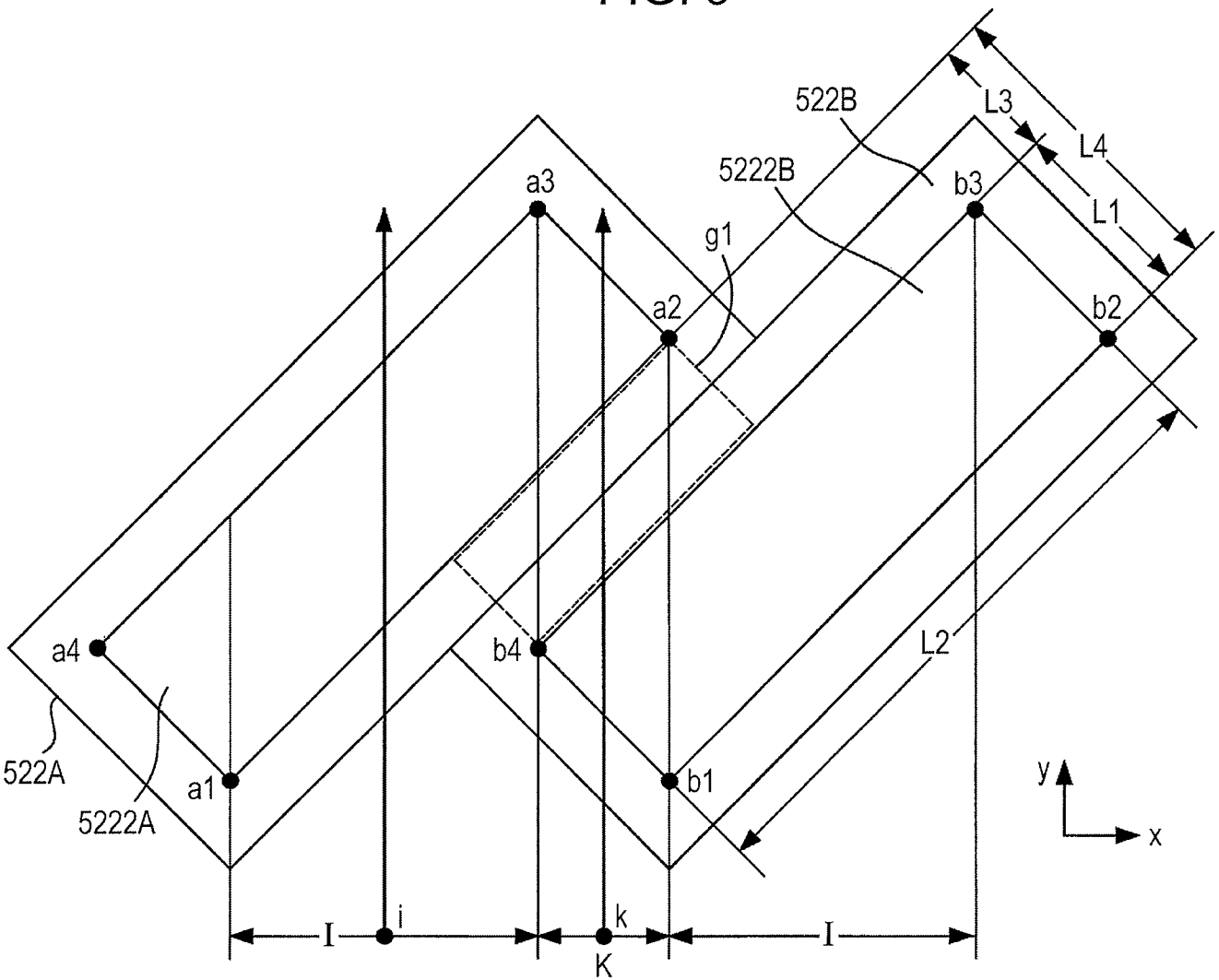
FIG. 9 illustrates the positional relationship between the chips according to the exemplary embodiment.

FIG. 9 illustrates the positional relationship between adjacent two of the chips 522 included in the light emitter 52. In this case, one of the two adjacent chips 522 whose x coordinate is the smaller is denoted as a chip 522A (an exemplary first chip), and the other whose x coordinate is the larger is denoted as a chip 522B (an exemplary second chip). The chip 522A and the chip 522B include a light-emitting area 5222A (an exemplary first light-emitting area) and a light-emitting area 5222B (an exemplary second light-emitting area), respectively. A portion of the light-emitting area 5222A and a portion of the light-emitting area 5222B overlap each other in the y-axis direction. The light-emitting area 5222A has four vertices a1 to a4. The light-emitting area 5222B has four vertices b1 to b4. Each of the vertices a1 and b1 has the smallest y coordinate among the vertices a1 to a4 or the vertices b1 to b4. Each of the vertices a2 and b2 has the largest x coordinate among the vertices a1 to a4 or the vertices b1 to b4. Each of the vertices a3 and b3 has the largest y coordinate among the vertices a1 to a4 or the vertices b1 to b4. Each of the vertices a4 and b4 has the smallest x coordinate among the vertices a1 to a4 or the vertices b1 to b4. The chip 522A and the chip 522B are arranged satisfying conditions listed below:

(1) The long sides L2 of the light-emitting areas 5222A and 5222B are angled by 45 degrees with respect to the y axis.

(2) A gap g1 extends between one of the long side L2 of the light-emitting area 5222A and one of the long side L2 of the light-emitting area 5222B that faces the former long side L2.

(3) The y coordinates of the vertices a1 and b1 are the same (or the y coordinates of the vertices a3 and b3 are the same).

(4) The x coordinates of the vertices a3 and b4 are the same (or the x coordinates of the vertices a2 and b1 are the same).

(5) The ratio of a length L4, which is the sum of a length L3 of the gap g1 in the direction parallel to the short sides L1 and a length L1, to a length L2 is 1:2.

In the above conditions, "length L1" denotes the length of each of the short sides L1 of the light-emitting areas 5222A and 5222B, and "length L2" denotes the length of each of the long sides L2 of the light-emitting areas 5222A and 5222B.

In Condition (1), the angle "45 degrees" implies not only an angle of exactly 45 degrees but also angles around 45 degrees including a certain margin of error. In Conditions (3) and (4), the term "the same" implies not only a case where the two coordinates are exactly the same but also cases where the difference between the coordinates of the two vertices falls within a certain margin of error. In Condition (5), the ratio "1:2" implies not only a case where the ratio of the length L4 to the length L2 is exactly 1:2 but also cases where the ratio of the length L4 to the length L2 is about 1:2 including a certain margin of error. If the chips 522 are arranged satisfying the above conditions, the accumulated light intensity becomes uniform within an area w0 illustrated in FIG. 3. In FIG. 3, as a matter of convenience of description, four chips 522 are illustrated. Practically, several hundreds of chips 522 are provided in the area w0, which extends longer than the paper width.

Figure 10:
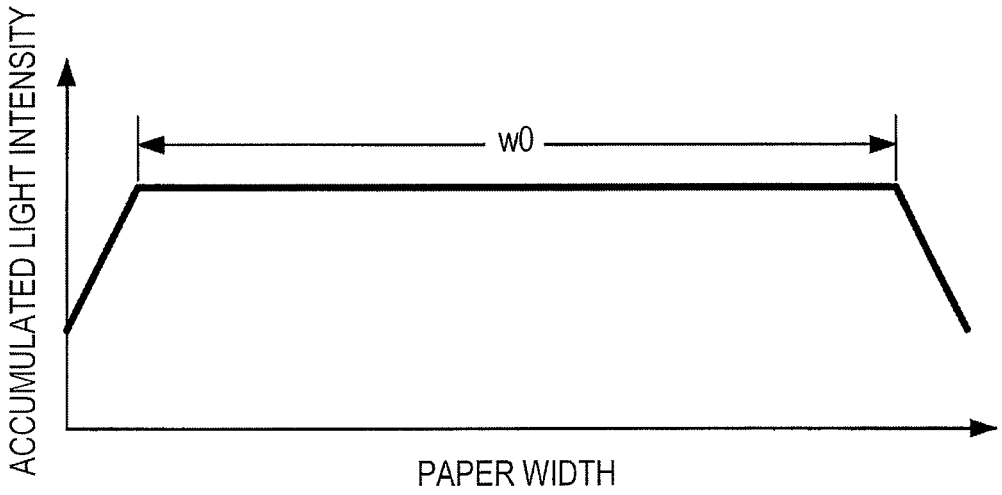
FIG. 10 is a graph illustrating the accumulated intensity of light applied to paper in the exemplary embodiment.

FIG. 10 is a graph illustrating the intensity of light applied to the paper P that accumulates in the transport direction in the fixing unit 50 according to the exemplary embodiment of the invention. In the case where the chips 522 are arranged as illustrated in FIGS. 3 and 9, different points on the paper P that are distributed in the width direction all travel through a uniform length of the light application area within the area w0 illustrated in FIG. 3. Therefore, the variation in the accumulated light intensity among the different points on the paper P measured while the points pass through the light application area falls within a specific range as illustrated in FIG. 10 (the variation becomes smaller than in the case of the comparative example illustrated in FIG. 8). That is, the nonuniformity in the fixing state of toner particles on the paper P is reduced. Herein, the term "specific range" refers to a margin of error defined such that the accumulated light intensity becomes uniform.

The present invention is not limited to the above exemplary embodiment. The above exemplary embodiment can be modified in various ways. Some exemplary modifications will be described below. Any combination of two or more of the following modifications is also acceptable.

(1) First Modification

Referring to FIG. 9 again, suppose that a point i defined in an area I of the paper P and a point k defined in an area K of the paper P pass through the light application area while traveling along the transport path. In this case, the point i passes through only a portion of the light application area that is subject to the light-emitting area 5222A of the chip 522A. In contrast, the point k passes through a portion of the light application area that is subject to the light-emitting area 5222A of the chip 522A and another portion of the light application area that is subject to the light-emitting area 5222B of the chip 522B. The point k also passes through an area corresponding to the gap g1. While the point k is traveling through the area corresponding to the gap g1, no light is applied to the point k. That is, the application of light is temporarily stopped while the point k passes through the two portions of the light application area.

Figure 11:
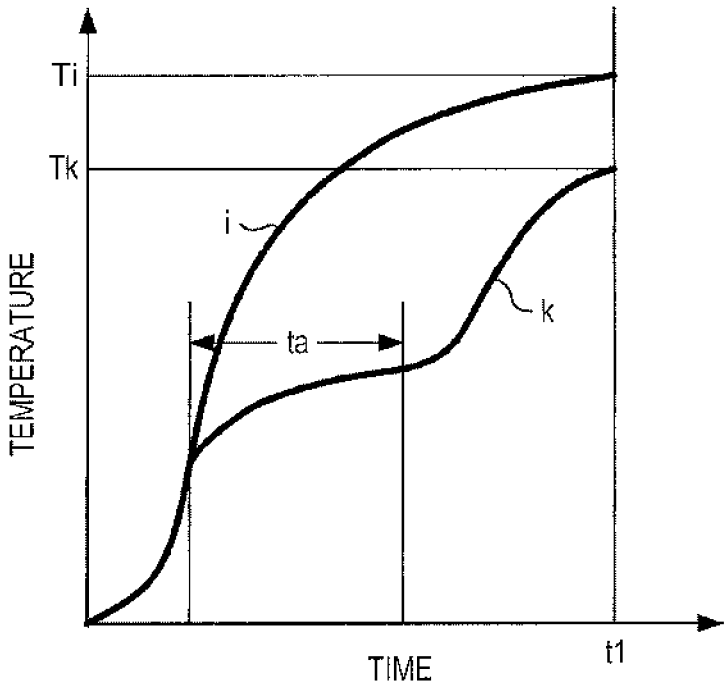
FIG. 11 is a graph illustrating changes in the temperature of toner particles in the exemplary embodiment.

FIG. 11 is a graph illustrating changes in the temperature of toner particles at the point i and the point k. The horizontal axis of the graph represents time. The vertical axis of the graph represents the temperature of toner particles. Since light is continuously applied to the point i, the temperature of toner particles at the point i continuously increases. In contrast, the rate of change in the temperature of toner particles at the point k decreases (the gradient of the temperature-time curve becomes gentle) over a period of time to in which the application of light to the point k is stopped. That is, even if the accumulated light intensity is uniform, a temperature Tk measured at a point of time t1 when the point k reaches the end of the light application area may become lower than a temperature Ti measured at the point of time t1 when the point i reaches the end of the light application area, depending on the continuity of the time period of light application. Such a temperature difference may cause nonuniformity in the fixing state.

Figure 12:
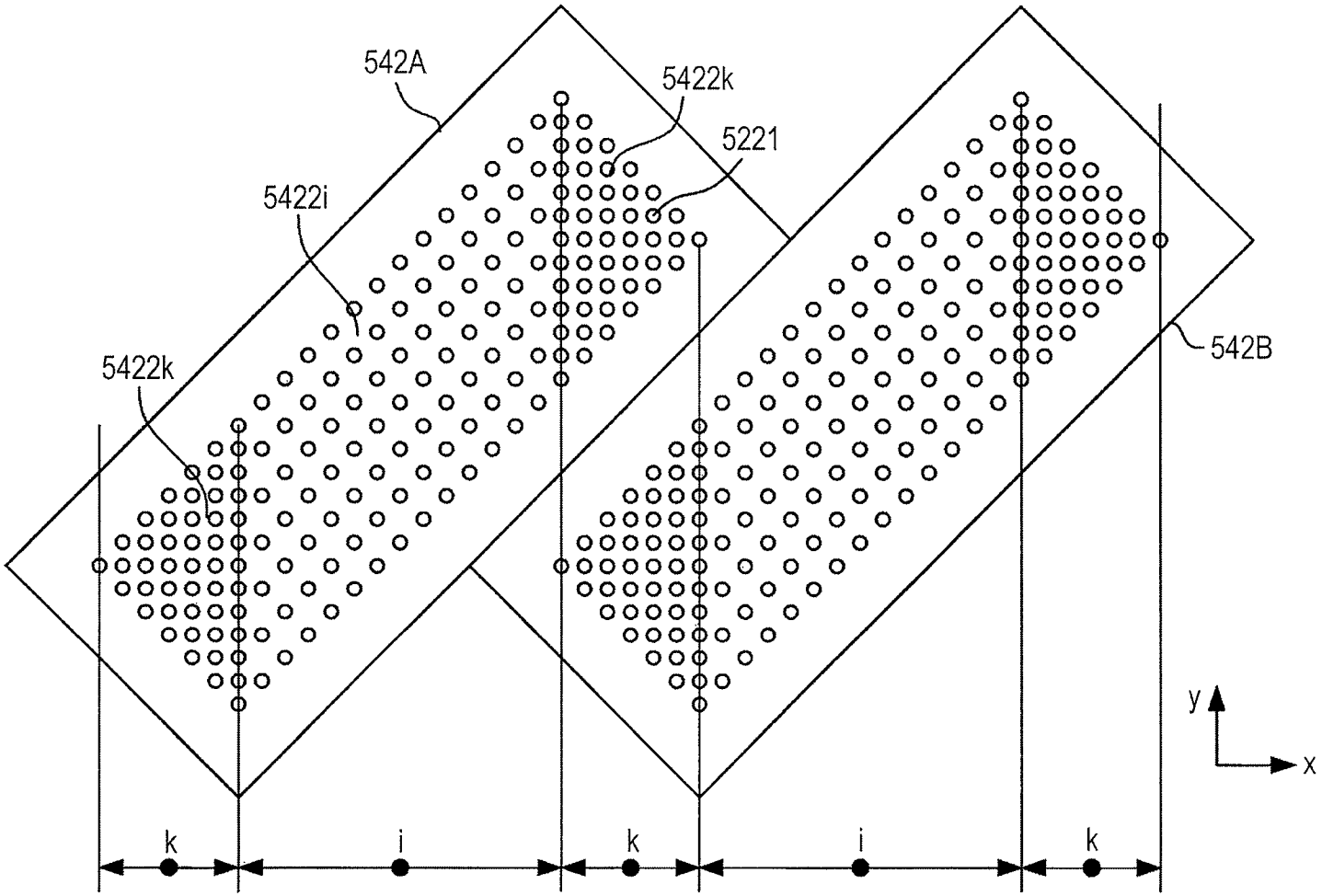
FIG. 12 illustrates a first modification of the exemplary embodiment.

FIG. 12 illustrates chips 542 according to a first modification of the exemplary embodiment. Respective light-emitting areas 5422 of a chip 542A and a chip 542B overlap each other in the y-axis direction in a light-emitting area 5422*k*, but do not overlap in the y-axis direction in each light-emitting area 5422*i*. In FIG. 12, the density of light-emitting elements 5221 (the density of the light-emitting elements 5221 in terms of the areas of their light-emitting surfaces) in the light-emitting area 5422*k* is higher than in the light-emitting area 5422*i*. That is, the quantity of light emitted per unit area is larger in the light-emitting area 5422*k* than in the light-emitting area 5422*i*. Such a difference in the density of light-emitting elements between two light-emitting areas compensates for the difference in the temperature of toner particles that may occur depending on the continuity of the time period of light application.

Figure 13:
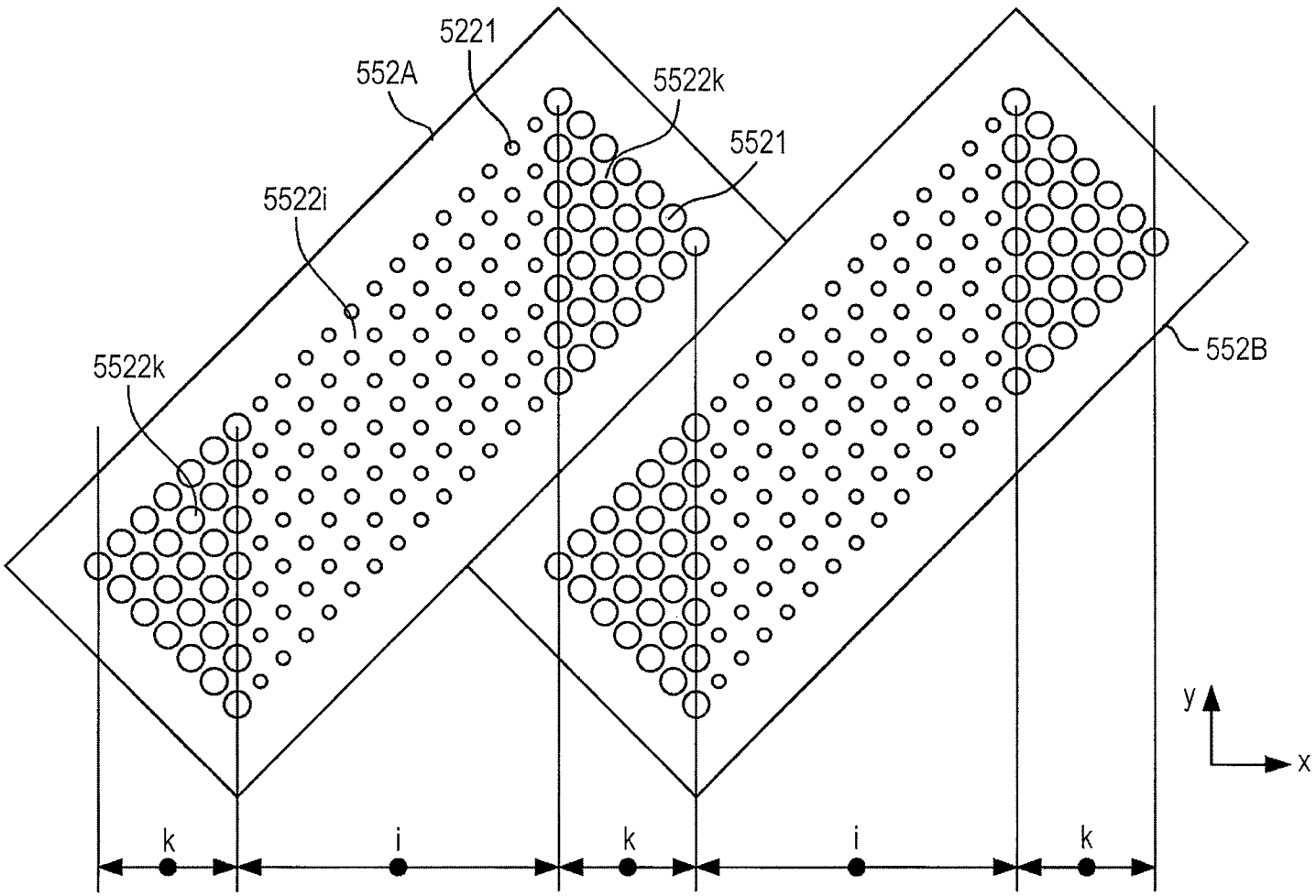
FIG. 13 also illustrates the first modification.

FIG. 13 illustrates chips 552 according to the first modification. Respective light-emitting areas 5522 of a chip 552A and a chip 552B overlap in the y-axis direction in a light-emitting area 5522*k*, but do not overlap in the y-axis direction in each light-emitting area 5522*i*. In FIG. 13, the size of light-emitting elements 5521 (the area of the light-emitting surface of each light-emitting element 5521) in the light-emitting area 5522*k* is larger than the size of light-emitting elements 5221 in the light-emitting area 5522*i*. That is, the quantity of light emitted per unit area is larger in the light-emitting area 5522*k* than in the light-emitting area 5522*i*. Such a difference in the size of light-emitting elements between two light-emitting areas compensates for the difference in the temperature of toner particles that may occur depending on the continuity of the time period of light application. In the first modification, the density or size of light-emitting elements is not necessarily uniform within the light-emitting area 5422*k* or 5522*k*, and the quantity of light emitted per unit area may vary with x coordinate within the light-emitting area 5422*k* or 5522*k*.

(2) Second Modification

Figure 14:
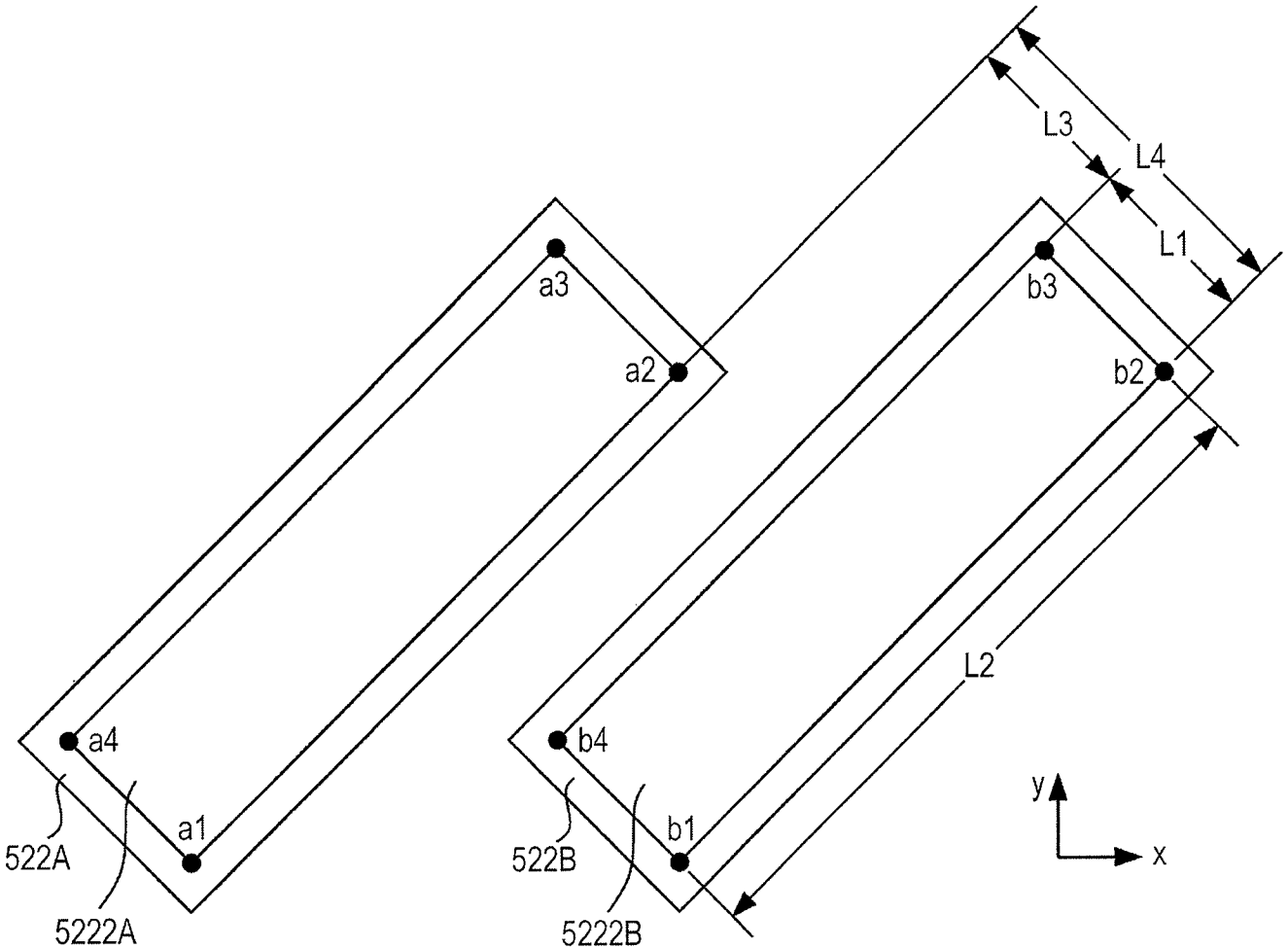
FIG. 14 illustrates a second modification of the exemplary embodiment.

FIG. 14 illustrates an arrangement of chips 522 according to a second modification of the exemplary embodiment. As illustrated in FIG. 14, adjacent two of the chips 522, i.e., a chip 522A and a chip 522B, may be provided at a certain distance from each other. In this case also, the chip 522A and the chip 522B are arranged such that Conditions (1) to (5) provided above are satisfied. Thus, even if the chips 522 are provided at certain distances from each other, different points on the paper P that are distributed in the width direction all travel through a uniform length of the light application area.

(3) Third Modification

Figure 15:
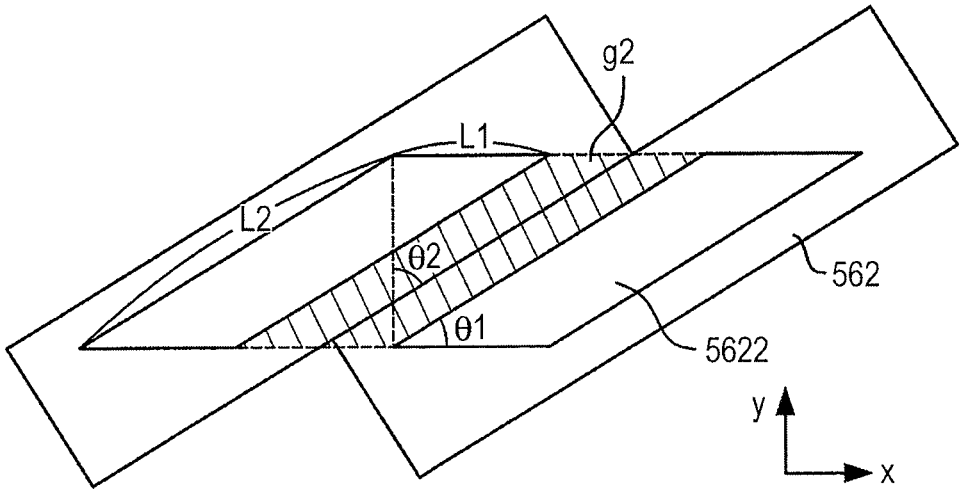
FIG. 15 illustrates a third modification of the exemplary embodiment.

FIG. 15 illustrates light-emitting areas 5622 according to a third modification of the exemplary embodiment that have different shapes from those of the first and second modifications. The light-emitting areas each do not necessarily have a rectangular or substantially rectangular shape. In FIG. 15, each chip 562 has a light-emitting area 5622 having a parallelogrammatic or substantially parallelogrammatic shape. The light-emitting area 5622 has short sides L1 and long sides L2. The above exemplary embodiment concerns a case where the four sides of the quadrilateral circumscribing the light-emitting elements are parallel to the four respective sides of the chip. In the third modification of the exemplary embodiment, only the long sides L2 of the quadrilateral circumscribing the light-emitting elements are parallel to corresponding two of the four sides of the chip 562, while the short sides L1 of the quadrilateral are each at a predetermined angle with respect to a corresponding one of the long sides L2. The short side L1 and the long side L2 form an angle θ1, which is expressed as $\theta 1=(90°-\theta 2)$, where θ2 denotes the angle formed between the virtual line extending in the transport direction and the long side of the chip 562. An area (hatched area) enclosed by the extensions of the short sides L1 of the two adjacent light-emitting areas 5622, a long side L2 of one of the two adjacent light-emitting areas 5622, and a long side L1 of the other light-emitting area 5622 that faces the former long side L1 is denoted as a gap g2.

Figure 16:
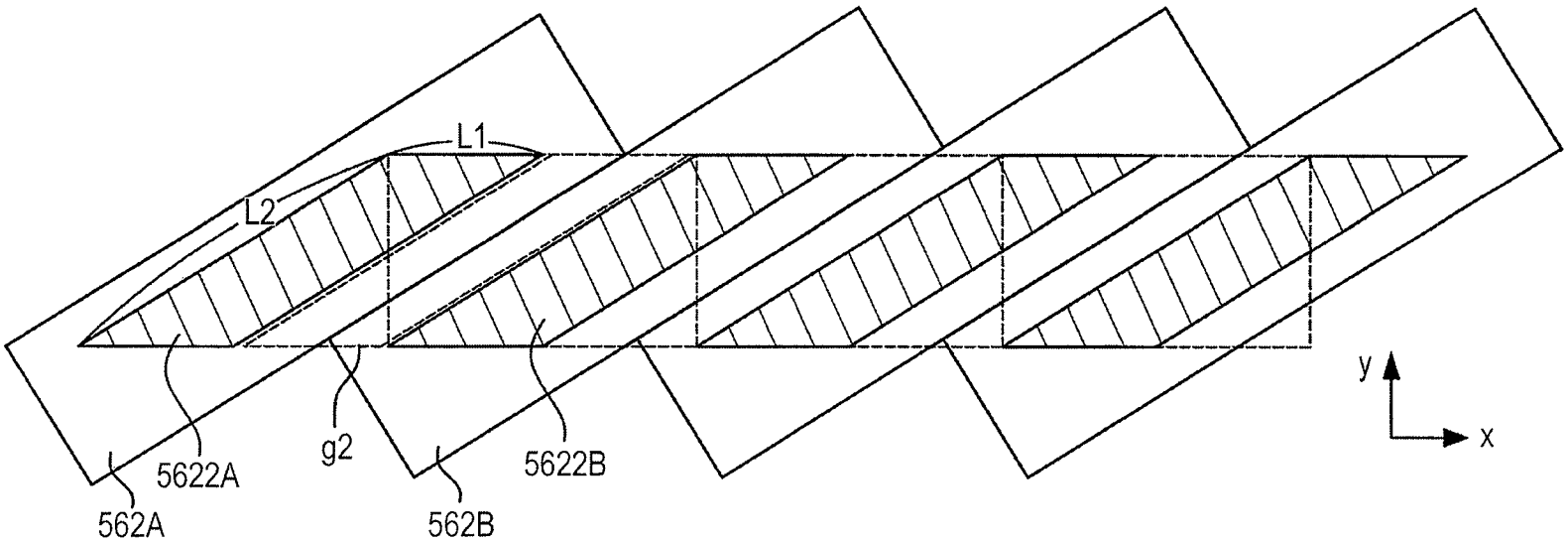
FIG. 16 also illustrates the third modification.

FIG. 16 illustrates the positional relationship between adjacent ones of the chips 562 according to the third modification. In this case, one of the chips 562 whose x coordinate is the smallest is denoted as a chip 562A, and another chip 562 whose x coordinate is the second smallest is denoted as a chip 562B. The chip 562A and the chip 562B include a light-emitting area 5622A and a light-emitting area 5622B, respectively. A portion of the light-emitting area 5622A and a portion of the light-emitting area 5622B overlap each other in the y-axis direction.

The chips 562A and 562B are arranged satisfying conditions listed below:

(A) The short sides L1 of the light-emitting areas 5622A and 5622B are parallel to the x axis.

(B) Each short side L1 of the light-emitting area 5622A and a corresponding one of the short side L1 of the light-emitting area 5622B are in one straight line.

(C) A long side L2 of the light-emitting area 5622A resides adjacent to one of the long sides L2 of the light-emitting area 5622B.

In Condition (A), the term "parallel" implies not only a case where the short sides L1 are exactly parallel to the x axis but also cases where the angle formed between each short side L1 and the x axis is within a range including a certain margin of error (a certain range of variation resulting from the normal manufacturing process). In Condition (B), the expression "to be in one straight line" implies not only a case where each short side L1 of the light-emitting area 5622A and a corresponding one of the short sides L1 of the light-emitting area 5622B are exactly in one straight line but also cases where the two short sides L1 of the light-emitting areas 5622A and the 5622B extend in an area around one straight line defined by a certain margin of error. If the chips 562 are arranged satisfying the above conditions, different points on the paper P that are distributed in the width direction all travel through a uniform length of the light application area. According to the third modification, all points on the paper P excluding points in the areas facing the gaps g2 start to receive light simultaneously. As long as Conditions (A) to (C) are satisfied, the points on the paper P that are distributed in the width direction all travel through a uniform length of the light application area even if the chips 562 are arranged at certain distances from one another.

(4) Fourth Modification

Figure 17:
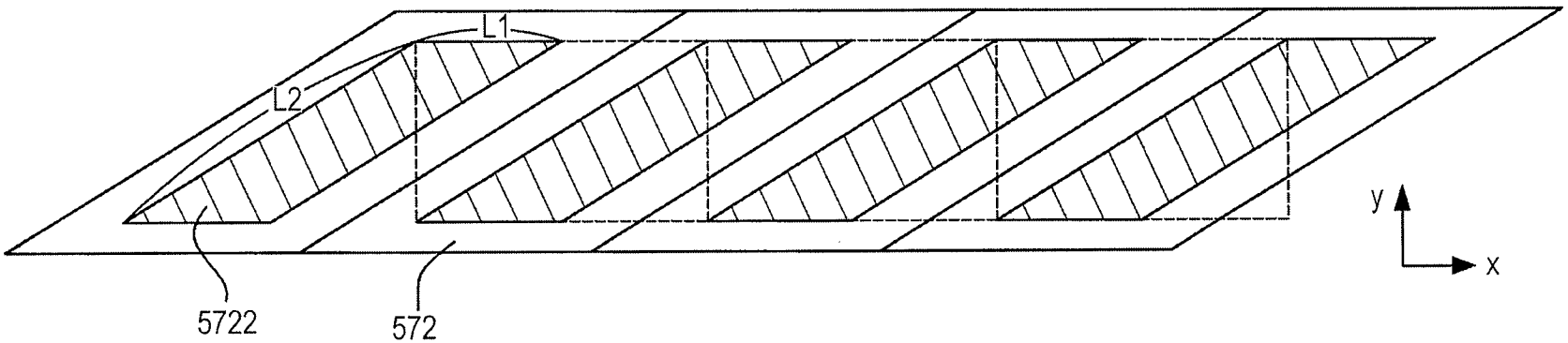
FIG. 17 illustrates a fourth modification of the exemplary embodiment.

FIG. 17 illustrates chips 572 according to a fourth modification of the exemplary embodiment each having a different shape from those of the first to third modifications. The chips each do not necessarily have a rectangular or substantially rectangular shape. In FIG. 17, the chips 572 each have a parallelogrammatic or substantially parallelogrammatic shape and include a light-emitting area 5722 having a parallelogrammatic or substantially parallelogrammatic shape. In the fourth modification also, if the chips 572 are arranged satisfying Conditions (A) to (C) provided in the third modification, different points on the paper P that are distributed in the width direction all travel through a uniform length of the light application area. The chips 572 may be arranged at certain distances from one another, as long as Conditions (A) to (C) are satisfied.

(5) Fifth Modification

The light-emitting elements according to the present invention are not limited to VCSELs and may be any light-emitting elements other than VCSELs, such as edge-emitting semiconductor lasers. Moreover, the light-emitting elements may be arranged in an irregular pattern, instead of a matrix pattern. For example, the chips may be one-dimensional-array chips.

(6) Sixth Modification

The driving circuit 523 may output individual driving signals to the plural light-emitting elements, respectively. The driving circuit 523 may be controlled to output individual driving signals to the respective light-emitting elements 5221 such that the accumulated light intensity becomes a predetermined value (for example, such that the light intensity that accumulates in the transport direction becomes uniform for all of different points on the paper P that are distributed in the width direction). By employing such a control method, the accumulated light intensity becomes uniform even if the light-emitting elements are arranged in an irregular pattern as in the fifth modification.

(7) Other Modifications

In this specification, the term "uniform" refers to a state where the variation in the accumulated light intensity or in the length of travel through the light application area falls within a predetermined range.

In the above exemplary embodiment, the direction in which the x axis extends is not limited to the direction illustrated in FIGS. 3, 9, and others.

The light-emitting areas and the chips may each have any shape instead of a rectangular or substantially rectangular shape or a parallelogrammatic or substantially parallelogrammatic shape, as long as the gaps extend at a certain angle with respect to the transport direction.

While toner is taken as an exemplary image forming material in the above exemplary embodiment, the image forming material may be ink. Ink dries when light is applied thereto. Thus, an image formed of ink is fixed.

Needless to say, a number of light-emitting chips are provided in the first direction and/or the second direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a transport member that transports a recording medium in a first direction, the recording medium having on one side thereof an image formed of an image forming material that is to be fixed by absorbing light;

a first chip that has a first light-emitting area in which a plurality of light-emitting elements that emit light toward the one side of the recording medium are arranged two-dimensionally; and a second chip that has a second light-emitting area in which a plurality of light-emitting elements that emit light toward the one side of the recording medium are arranged two-dimensionally, wherein a gap between the first light-emitting area and the second light-emitting area extends at a non-orthogonal angle with respect to the first direction, and a portion of the first light-emitting area and a portion of the second light-emitting area overlap each other in the first direction, wherein the first light-emitting area and the second light-emitting area each have a substantially rectangular shape, wherein the substantially rectangular shape has first-length sides and second-length sides wherein the second-length sides are angled by about 45 degrees with respect to the first direction, wherein the gap corresponds to an area extending between one of the second-length sides of the first light-emitting area and one of the second-length sides of the second light-emitting area that faces the one second-length sides of the first light-emitting area, wherein a positive side in the first direction corresponds to a downstream side toward which the recording medium is transported, wherein a positive side in the second direction corresponds to a side of the first chip nearer to the second chip, wherein one of four vertices of the first light-emitting area whose coordinate in the first direction is the smallest and one of four vertices of the second light-emitting area whose coordinate in the first direction is the smallest have the same coordinate in the first direction, wherein one of the four vertices of the first light-emitting area whose coordinate in the first direction is the largest and one of the four vertices of the second light-emitting area whose coordinate in the second direction is the smallest have the same coordinate in the second direction, and wherein the ratio of a length that is the sum of a length of the gap in a direction parallel to the first-length sides and a length of each of the first-length sides to a length of each of the second-length sides is 1:2.

2. The fixing device according to claim 1, wherein the intensity of light that accumulates in the first direction during a predetermined period of time has a distribution within a specific range in a second direction that is orthogonal to the first direction, the light being applied to the one side of the recording medium from the light-emitting elements of the first chip and the second chip.

3. An image forming apparatus comprising:

a transfer unit that transfers an image on a recording medium; and the fixing device according to claim 1.

4. A fixing device comprising:

a transport member that transports a recording medium in a first direction, the recording medium having on one side thereof an image formed of an image forming material that is to be fixed by absorbing light;

a first chip that has a first light-emitting area in which a plurality of light-emitting elements that emit light toward the one side of the recording medium are arranged two-dimensionally; and a second chip that has a second light-emitting area in which a plurality of light-emitting elements that emit light toward the one side of the recording medium are arranged two-dimensionally, wherein a gap between the first light-emitting area and the second light-emitting area extends at an angle with respect to the first direction, and a portion of the first light-emitting area and a portion of the second light-emitting area overlap each other in the first direction, wherein the quantity of light emitted per unit area is larger in the portions of the first light-emitting area and the second light-emitting area that overlap each other in the first direction than in other portions of the first light-emitting area and the second light-emitting area that are staggered from each other in the first direction.

5. The fixing device according to claim 4, wherein the first light-emitting area and the second light-emitting area each have a substantially parallelogrammatic shape, wherein the substantially parallelogrammatic shape has first-length sides and second-length sides, and wherein one of the second-length sides of the substantially parallelogrammatic shape of the first chip resides adjacent to one of the second-length sides of the substantially parallelogrammatic shape of the second chip, and each of the first-length sides of the substantially parallelogrammatic shape of the first chip and a corresponding one of the first-length sides of the substantially parallelogrammatic shape of the second chip are in one straight line.

6. The fixing device according to claim 4, wherein the gap between the first light-emitting area and the second light-emitting area extends at a non-orthogonal angle with respect to the first direction.

7. A fixing device comprising:

a transport member that transports a recording medium in a first direction, the recording medium having on one side thereof an image formed of an image forming material that is to be fixed by absorbing light;

a first chip that has a first light-emitting area in which a plurality of light-emitting elements that emit light toward the one side of the recording medium are arranged two-dimensionally; and a second chip that has a second light-emitting area in which a plurality of light-emitting elements that emit light toward the one side of the recording medium are arranged two-dimensionally, wherein a gap between the first light-emitting area and the second light-emitting area extends at an angle with respect to the first direction, and a portion of the first light-emitting area and a portion of the second light-emitting area overlap each other in the first direction, wherein the first light-emitting area and the second light-emitting area each have a substantially parallelogrammatic shape, wherein the substantially parallelogrammatic shape has first-length sides and second-length sides, and wherein one of the second-length sides of the substantially parallelogrammatic shape of the first chip resides adjacent to one of the second-length sides of the substantially parallelogrammatic shape of the second chip, and each of the first-length sides of the substantially parallelogrammatic shape of the first chip and a corresponding one of the first-length sides of the substantially parallelogrammatic shape of the second chip are in one straight line.

8. The fixing device according to claim 7, wherein the gap between the first light-emitting area and the second light-emitting area extends at a non-orthogonal angle with respect to the first direction.

* * * * *